US006564578B1

(12) United States Patent
Fischer-Calderon

(10) Patent No.: US 6,564,578 B1
(45) Date of Patent: May 20, 2003

(54) SELF-REFRIGERATED LNG PROCESS

(75) Inventor: Ernesto Fischer-Calderon, Missouri City, TX (US)

(73) Assignee: BP Corporation North America Inc., Chicago, IL (US)

( * ) Notice: Subject to any disclaimer, the term of this patent is extended or adjusted under 35 U.S.C. 154(b) by 0 days.

(21) Appl. No.: 10/050,922

(22) Filed: Jan. 18, 2002

(51) Int. Cl.[7] ..... F25J 1/00; F25J 3/00
(52) U.S. Cl. ..... 62/613; 62/619
(58) Field of Search ..... 62/611, 613, 612, 62/619

(56) References Cited

U.S. PATENT DOCUMENTS

| | | | | |
|---|---|---|---|---|
| 2,814,936 A | * | 12/1957 | Morrison | 62/116 |
| 3,162,519 A | | 12/1964 | Peters et al. | |
| 3,331,214 A | * | 7/1967 | Proctor et al. | 48/127.3 |
| 3,360,944 A | | 1/1968 | Knapp et al. | |
| 3,373,574 A | * | 3/1968 | Fisher | 62/619 |
| 3,383,873 A | | 5/1968 | Becker | |
| 3,616,652 A | | 11/1971 | Engel | |
| 3,721,099 A | * | 3/1973 | Forg et al. | 62/612 |
| 3,735,600 A | | 5/1973 | Dowdell et al. | |
| 4,065,278 A | | 12/1977 | Newton et al. | |
| 4,172,711 A | | 10/1979 | Bailey | |
| 4,195,979 A | | 4/1980 | Martin | |
| 4,274,849 A | | 6/1981 | Garier et al. | |
| 4,445,917 A | | 5/1984 | Chiu | |
| 4,456,459 A | | 6/1984 | Brundige, Jr. | |
| 4,504,296 A | | 3/1985 | Newton et al. | |
| 4,525,185 A | | 6/1985 | Newton | |
| 4,545,795 A | | 10/1985 | Liu et al. | |
| 4,559,069 A | * | 12/1985 | Becker | 62/613 |
| 4,638,638 A | * | 1/1987 | Marshall et al. | 62/51.1 |
| 4,698,080 A | | 10/1987 | Gray et al. | |

(List continued on next page.)

FOREIGN PATENT DOCUMENTS

WO 0144735 6/2001

OTHER PUBLICATIONS

Geijsel et al.,"Synergies Between LNG and Gas to Liquids Conversion," 9 pages (not numbered), M.M.G. Senden, Shell Global Solutions International, The Netherlands.

"LNG Supplement/Reliquefaction . . . Economics And Systems," 1 page, Jan. 1975, Tanker Bulk Carrier V20 N.20 39–40 (Jan. 1975).

G.G. Haselden, "The Liquefaction of Natural Gas," 1 page, Contemp. Phys. V18 471–88 (1977)(Abstr.) Gas Abstr. V34 N.2 10 (Feb. 1978).

D. Bergmann, "Process Drivers/Selection Guide For Expansion Turbines," 1 page, Hydrocarbon Process V58 N.8 83–86 (Aug. 1979).

*Primary Examiner*—William C. Doerrler
(74) *Attorney, Agent, or Firm*—Patrick J. Kim; Thomas A. Yassen; John L. Wood

(57) ABSTRACT

The present invention is directed to a process for producing LNG by directing a feed stream comprising natural gas to a cooling stage that (a) cools the feed stream in at least one cooling step producing a cooled feed stream, (b) expands the cooled feed stream in at least one expansion step by reducing the pressure of the cooled feed stream producing a refrigerated vapor component and a liquid component, and (c) separates at least a portion of the refrigerated vapor component from the liquid component wherein at least a portion of the cooling for the process is derived from at least a portion of the refrigerated vapor component; and repeating steps (a) through (c) one or more times until at least substantial portion of the feed stream in the first cooling stage is processed into LNG wherein the feed stream in step (a) comprises at least a portion of the liquid component produced from a previous cooling stage.

22 Claims, 1 Drawing Sheet

U.S. PATENT DOCUMENTS

| | | | |
|---|---|---|---|
| 4,755,200 | A | 7/1988 | Liu et al. |
| 4,778,497 | A | 10/1988 | Hanson et al. |
| 4,901,533 | A | 2/1990 | Fan et al. |
| 4,911,741 | A | 3/1990 | Davis et al. |
| 4,970,867 | A | 11/1990 | Herron et al. |
| 5,036,671 | A | 8/1991 | Nelson et al. |
| 5,139,548 | A | 8/1992 | Liu et al. |
| 5,359,856 | A | 11/1994 | Rhoades et al. |
| 5,363,655 | A | 11/1994 | Kikkawa et al. |
| 5,535,594 | A | 7/1996 | Grenier |
| 5,537,827 | A | 7/1996 | Low et al. |
| 5,611,216 | A | 3/1997 | Low et al. |
| 5,613,373 | A | 3/1997 | Grenier |
| 5,615,561 | A | 4/1997 | Houshmand et al. |
| 5,669,234 | A | 9/1997 | Houser et al. |
| 5,718,126 | A | 2/1998 | Capron et al. |
| 5,755,114 | A | 5/1998 | Foglietta |
| 5,813,250 | A | 9/1998 | Ueno et al. |
| 5,826,444 | A | 10/1998 | Capron et al. |
| 5,832,745 | A | 11/1998 | Klein Nagelvoort et al. |
| 5,916,260 | A | 6/1999 | Dubar |
| 5,943,881 | A | 8/1999 | Grenier |
| 5,950,453 | A | 9/1999 | Bowen et al. |
| 6,016,665 | A | 1/2000 | Cole et al. |
| 6,023,942 | A | 2/2000 | Thomas et al. |
| 6,041,619 | A | 3/2000 | Fischer et al. |
| 6,062,041 | A | 5/2000 | Kikkawa et al. |
| 6,085,545 | A | 7/2000 | Johnston |
| 6,085,546 | A | 7/2000 | Johnston |
| 6,085,547 | A | 7/2000 | Johnston |
| 6,094,937 | A | 8/2000 | Paurola et al. |
| 6,105,389 | A | 8/2000 | Paradowski et al. |
| 6,269,656 | B1 | 8/2001 | Johnston |
| 6,289,692 | B1 | 9/2001 | Houser et al. |

* cited by examiner

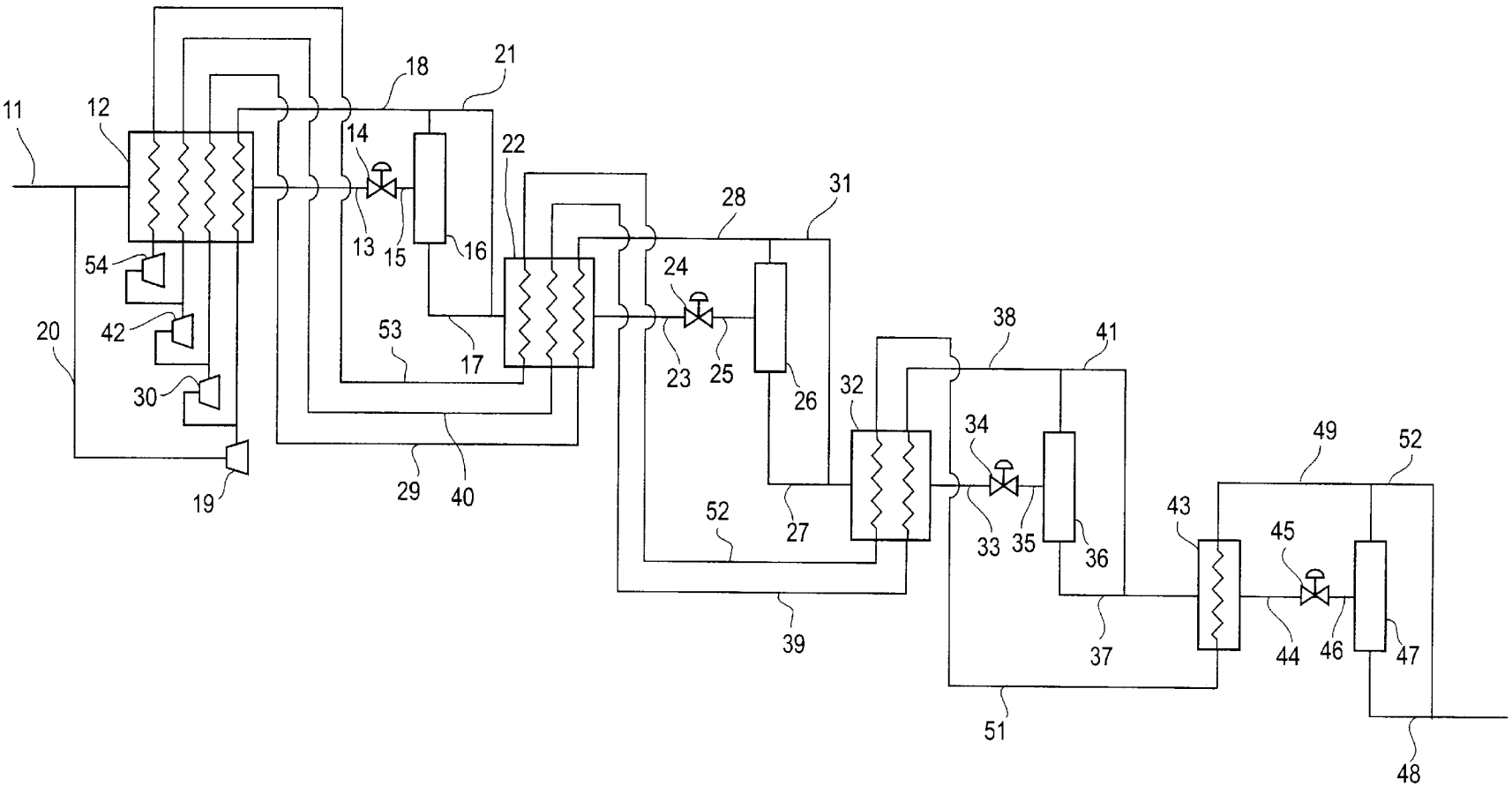
11
12
13
14
15
16
17
18
19
20
21
22
23
24
25
26
27
28
29
30
31
32
33
34
35
36
37
38
39
40
41
42
43
44
45
46
47
48
49
51
52
53
54

SELF-REFRIGERATED LNG PROCESS

FIELD OF INVENTION

The present invention relates to a process for the liquefaction of natural gas and more particularly the liquefaction of natural gas to LNG (at atmospheric pressure) that does not require the use of external refrigerants.

BACKGROUND OF THE INVENTION

Natural gas is an increasingly used fuel source throughout the world. Consequently, efforts for its production continue to grow in remote areas of the world where safe transportation of the natural gas to distant markets is impractical or requires significant capital expense. Where pipeline transportation of natural gas is not available or practical, liquefaction of natural gas is currently practiced as a cost effective option for transporting natural gas to worldwide markets.

As used throughout the specification, natural gas is understood to mean raw natural gas or treated natural gas. Raw natural gas primarily comprises light hydrocarbons such as methane, ethane, propane, butanes, pentanes, hexanes and impurities like benzene, but may also comprise small amounts of non-hydrocarbon impurities, such as nitrogen, hydrogen sulfide, carbon dioxide, and traces of helium, carbonyl sulfide, various mercaptans or water. Treated natural gas primarily comprises methane and ethane, but may also comprise a small percentage of heavier hydrocarbons, such as propane, butanes and pentanes.

As used throughout the specification, liquefied natural gas ("LNG") is understood to mean natural gas that is reduced to a liquefied state at or near atmospheric pressure. As used herein, near atmospheric pressure is generally understood to mean no more than about 25 psia, commonly not more than about 20 psia, and often not more than about 15 psia.

The liquefaction of natural gas is generally accomplished by reducing the temperature of natural gas to a liquefaction temperature of about −240° F. to about −260° F. at or near atmospheric pressure. This liquefaction temperature range is typical for many natural gas streams because the boiling point of methane at atmospheric pressure is about −259° F. In order to produce, store and transport LNG, conventional processes known in the art require substantial refrigeration to reduce and maintain natural gas at its liquefaction temperature. The most common of these refrigeration processes are: (1) the cascade process; (2) the single mixed refrigerant process; and (3) the propane pre-cooled mixed refrigerant process.

A cascade process produces LNG by employing several closed-loop cooling circuits, each utilizing a single pure refrigerant and collectively configured in order of progressively lower temperatures. The first cooling circuit commonly utilizes propane or propylene as the refrigerant, the second circuit may utilize ethane or ethylene, while the third circuit generally utilizes methane as the refrigerant.

A single mixed refrigerant process produces LNG by employing a single closed-loop cooling circuit utilizing a multicomponent refrigerant consisting of components such as nitrogen, methane, ethane, propane, butanes and pentanes. The mixed refrigerant undergoes the steps of condensation, expansion and recompression to reduce the temperature of natural gas by employing a unitary collection of heat exchangers known as a "cold box."

A propane pre-cooled mixed refrigerant process produces LNG by employing an initial series of propane-cooled heat exchangers in addition to a single closed-loop cooling circuit, which utilizes a multi-component refrigerant consisting of components such as nitrogen, methane, ethane and propane. Natural gas initially passes through one or more propane-cooled heat exchangers, proceeds to a main exchanger cooled by the multi-component refrigerant, and is thereafter expanded to produce LNG.

Most LNG liquefaction plants utilize one of these natural gas liquefaction processes. Unfortunately, the construction and maintenance of such plants is expensive because of the cost of constructing, operating and maintaining one or more external, single or mixed refrigerant, closed-loop cooling circuits.

Another penalty associated with external closed-loop cooling circuits is that such circuits require the use and storage of highly explosive refrigerants that can present safety concerns. Refrigerants such as propane, ethylene and propylene are explosive, while propane and propylene, in particular, are heavier than air further complicating dispersion of these gases in the event of a leak or other equipment failure. This is of particular concern during the offshore production and transport of LNG by ocean going vessels or other floating vessels because of: (1) the large amount of refrigerants that must be stored in order to maintain the liquefaction temperature of natural gas; and (2) the close proximity of these refrigerants to the ships crew.

Consequently, there is a need for a cost efficient means for safely producing, storing and transporting LNG to commercial markets around the world. The current methods have only partially succeeded in providing a safe yet cost effective process.

One such effort is U.S. Pat. No. 5,755,114 issued to Foglietta, which discloses a hybrid liquefaction cycle for the production of LNG. The Foglietta process passes a pressurized natural gas feed stream into heat exchange contact with a closed-loop propane or propylene refrigeration cycle prior to directing the natural gas feed stream through a turboexpander cycle to provide auxiliary refrigeration. The Foglietta process can be implemented with only one closed-loop refrigeration cycle, as opposed to cascade type mixed refrigerant systems currently used to produce atmospheric LNG. However, the Foglietta process still requires at least one closed-loop refrigeration cycle comprising propane or propylene, both of which are explosive, not easily dispersed and must be stored on the vessels that transport the Foglietta product.

U.S. Pat. No. 3,360,944 to Knapp et al. produces LNG by separating a natural gas feed stream into a major stream and a minor stream, cooling the major and minor streams to produce a liquid component, and thereafter using a substantial portion a the liquid component as a refrigerant for the process. The liquid component is vaporized while undergoing heat exchange, compressed and discharged from the process. The Knapp process results in only a minor portion of the natural gas feed stream processed into LNG.

U.S. Pat. No. 6,023,942 to Thomas et al. discloses a process for producing a methane-rich liquid product having a temperature above about −112° C. (−170° F.) at a pressure that is sufficient for the liquid product to be at or below its bubble point. The resulting product is a pressurized liquid natural gas ("PLNG"), which has a pressure substantially above atmospheric pressure. While the Thomas et al. process can be implemented without external refrigeration, the product is pressurized requiring the use of specially designed heavy, thick-walled containers and transports (e.g., a PLNG ship, truck or railcar). This higher pressure, heavier walled equipment adds substantial weight and expense to any commercial project. The PLNG consumer will also require additional liquefaction, transport, and storage equipment to consume the PLNG, adding further cost to the supply and demand value chain.

U.S. Pat. No. 3,616,652 to Engal discloses a process for producing LNG in a single stage by compressing a natural gas feed stream, cooling the compressed natural gas feed stream to produce a liquefied stream, dramatically expanding the liquefied stream to an intermediate-pressure liquid, and then flashing and separating the intermediate-pressure liquid in a single separation step to produce LNG and a low-pressure flash gas. The low-pressure flash gas is recirculated, substantially compressed and reintroduced into the intermediate pressure liquid.

While the Engal process produces LNG without the use of external refrigerants, the process inefficiently utilizes its limited refrigeration capacity upon the entire process stream without conjunctive use of multiple separation steps to offset this severe cooling requirement. Furthermore, the Engal process inefficiently expands its process stream pressure to a level that results in a substantial and highly inefficient recompression of its flash gas. Consequently, the Engal process yields a small volume of LNG compared to the amount of work required for its production, thus reducing the cost viability of the process.

Although these processes provide great advances in the art, none have satisfied the need for a process that is safe yet cost effective for manufacturing LNG.

We have now found that processing a single stream of natural gas into LNG while deriving the refrigeration for the process from flash gases separated in multiple sequential separation steps results in enhanced LNG production and reduced equipment costs compared to processes that produce LNG by splitting the feed stream into major and minor natural gas streams and producing a liquid component for its refrigeration requirements.

We have also found that staging the degree of expansion of a high-pressure natural gas feed stream across multiple cooling/expansion/separation steps or cooling stages enhances the production of LNG while reducing the power consumption for its production compared to LNG processes that dramatically reduce the pressure of a high-pressure natural gas feed stream across a single expansion step or cooling stage.

We have also found that processing a single stream of natural gas into LNG by utilizing a plurality of cooling stages comprising two or more separation steps in conjunction with at least an equal number of expansion steps substantially reduces the refrigeration requirements for the process, thus enhancing the production of LNG while reducing the equipment costs compared to processes that produce LNG without the use of such linked multiple expansion and separation steps.

SUMMARY OF THE INVENTION

Therefore, the present invention is directed to a process for producing LNG by directing a feed stream comprising natural gas to a cooling stage that (a) cools the feed stream in at least one cooling step producing a cooled feed stream, (b) expands the cooled feed stream in at least one expansion step by reducing the pressure of the cooled feed stream producing a refrigerated vapor component and a liquid component, and (c) separates at least a portion of the refrigerated vapor component from the liquid component wherein at least a portion of the cooling for the process is derived from at least a portion of the refrigerated vapor component; and repeating steps (a) through (c) one or more times until at least a substantial portion of the feed stream in the first cooling stage is processed into LNG wherein the feed stream in step (a) comprises at least a portion of the liquid component produced from a previous cooling stage.

In another embodiment, the present invention is directed to a process for producing LNG by directing a feed stream comprising natural gas to a cooling stage that (a) cools the feed stream in at least one cooling step producing a cooled feed stream, (b) expands the cooled feed stream in at least one expansion step by reducing the pressure of the cooled feed stream producing a refrigerated vapor component and a liquid component, and (c) separates at least a portion of the refrigerated vapor component from the liquid component wherein at least a portion of the cooling for the process is derived from at least a portion of the refrigerated vapor component; and repeating steps (a) through (c) one or more times wherein the feed stream in step (a) comprises at least a portion of the liquid component produced from a previous cooling stage wherein the inlet pressure of the feed stream in step (b), as measured in psia, is at least ½ the inlet pressure of the feed stream in step (a), as measured in psia, of the immediately preceding cooling stage provided that the inlet pressure of said feed stream in step (a) is at least 150 psia.

The present invention provides for a cost effective process for producing LNG that does not require the costly capital necessary for closed-loop refrigeration circuits.

The present invention also provides a cost effective process for producing LNG that does not require high-pressure containers and transport equipment for handling highly pressurized LNG product nor does the process require customers to erect special handling facilities and equipment required for consuming high pressure LNG.

The present invention also provides a process for producing LNG that does not require explosive external refrigerants during the manufacture, storage or transportation of LNG.

The present invention also provides for a simple and compact design option for the production of LNG facilitating implementation of the process at locations where plot space is at a premium or unavailable.

The present invention also provides a process for producing fuel gas for internal process consumption, while maintaining a high rate of LNG production and efficient power consumption for the process.

The present invention also permits manufacture of a high quality LNG product having low concentrations of inert components, such as nitrogen, and the ability to remove NGL components, such as ethane, propane, butanes and pentanes and heavier components, and Benzene from the feed.

BRIEF DESCRIPTION OF THE DRAWING

The FIGURE is an embodiment of a process in accordance with the present invention comprising three cooling stages.

DESCRIPTION OF THE PREFERRED EMBODIMENTS

In greater detail, the subject invention is directed to a process for producing LNG from a feed stream comprising natural gas. As previously defined herein, natural gas is understood to mean raw natural gas and treated natural gas, both of which are suitable feed streams for the process.

Natural gas primarily comprises light hydrocarbons such as methane, ethane, propane and butane, but may also comprise small amounts of non-hydrocarbon impurities, such as nitrogen, hydrogen sulfide, carbon dioxide, and traces of helium, carbonyl sulfide, various mercaptans or water. The exact percentage composition of the raw natural gas is dependant upon its reservoir source and any gas plant pre-processing steps. For instance, natural gas may comprise as little as 55 mole percent methane. However, it is preferable that the natural gas suitable for this process comprises at least about 75 mole percent methane, more preferably at least about 85 mole percent methane, and most preferably at least about 90 mole percent methane for best results. Likewise, the exact composition of the non-hydrocarbon impurities also varies depending upon the reservoir source of the natural gas. Consequently, it is often necessary to pretreat the natural gas to remove high concentrations of non-hydrocarbon impurities, such as acid gases, mercury and water, that can damage, freeze and plug lines and heat exchangers or other equipment used in the process. Suitable pretreatment methods to remove these non-hydrocarbon impurities include amine extraction or desiccation via the use of molecular sieves.

The inlet pressure of the natural gas feed stream for the process can encompass a wide range of pressures. Where the natural gas is pipeline gas, the inlet pressure of the natural gas feed stream is typically dependent upon the delivery pressure of the pipeline transporting the natural gas. Pipeline delivery pressures can range from about 500 psia to about 1,800 psia, but may be as high as 2,800 psia. It is preferable that the inlet pressure of the natural gas feed stream is at least about 600 psia, more preferably at least about 800 psia, and yet more preferably at least about 1000 psia, and most preferably at least about 1200 psia for best results. The inlet temperature of the natural gas feed stream for the process can encompass a wide range of temperatures, but is typically dependent upon the delivery temperature of the pipeline transporting the natural gas, which is often from about 0° F. to 120° F.

The FIGURE depicts a preferred embodiment that utilizes three cooling stages. A single cooling stage of the process comprises cooling a feed stream comprising natural gas in at least one cooling step producing a cooled feed stream; expanding the cooled feed stream in at least one expansion step by reducing the pressure of the cooled feed stream producing a refrigerated vapor component and a liquid component; and separating at least a portion of the refrigerated vapor component from the liquid component in at least one separation step. It is preferred that at least portion of the cooling for at least one cooling stage is derived from at least a portion of the refrigerated vapor component produced in at least one cooling stage utilized in the process. A single cooling stage may further comprise the steps of compressing the refrigerated vapor component to produce a compressed vapor component and recycling the compressed vapor component into the feed stream of one or more cooling stages.

Referring to the FIGURE, the feed stream comprising natural gas is introduced into line 11 of a first cooling stage of the process. Once the feed stream is introduced into line 11, it is directed to heat exchanger 12 wherein the feed stream is cooled through indirect heat exchange contact with refrigerated vapor components introduced into heat exchanger 12 from line 18 producing a cooled feed stream. This initial heat exchange preferably cools the feed stream to an intermediate temperature of about 0° F. or lower, preferably to about −12.5° F. or lower, more preferably to about −31° F. or lower, and most preferably to about −50° F. or lower. The feed stream can be initially cooled to any desired temperature suitable for this process. However, for best results, it is preferable that the feed stream is not cooled below about −116° F. during the initial heat exchange because such cooling would require inefficient utilization of refrigerant internally produced in at least downstream cooling stage of the process (i.e. inefficiently dedicating colder refrigerants for initial cooling loads).

Suitable heat exchangers for the process include, but are not limited to, tube-and-shell heat exchangers, core-in-kettle exchangers and brazed aluminum plate-fin heat exchangers. The preferred heat exchanger for one or more heat exchangers employed in the process is a brazed aluminum plate-fin heat exchanger.

Following the initial cooling step, the cooled feed stream is passed through into line 13 where it is charged into expansion device 14 where the cooled feed stream is isentropically or isenthalpically expanded to a lower pressure producing a refrigerated vapor component and a liquid component. Although not illustrated in the FIGURE, the cooled feed stream can be expanded in multiple expansion steps without intervening separation steps. However, it is preferred that a cooling stage utilizing multiple expansion steps is configured such that each expansion step is individually to linked to a separation step.

Suitable isenthalpic expansion devices can be of any conventional variety known in the art, including, but not limited to, valves, control valves, Joule Thompson valves, Venturi devices, and the like. However, the preferred isenthalpic expansion devices are automatically actuated expansion valves or Joule Thompson valves. Suitable isentropic expansion devices for the subject invention include, but are not limited to, expanders or turbo expanders that derive, recover, or extract work from such expansion.

Isenthalpic or isentropic expansion can be conducted in the all-liquid phase, all vapor phase, mixed phases or can be conducted so as to facilitate a phase change from liquid to vapor. Isenthalpic or isentropic expansion as contemplated herein can be controlled to maintain a constant pressure drop or temperature reduction across the expansion device or cooling stage, to maintain LNG product phase and volume, or to provide an appropriate pressure for the process feed stream so as to direct its flow into a particular downstream use.

It has been found that particularly staging the degree of expansion across the expansion device or cooling stage results in substantial reductions in overall energy requirements and equipment costs to produce LNG. Such a novel process configuration synergistically integrates the number of expansion/separation steps or cooling stages with compression requirements and ratios for internally producing vapor components that are introduced into various upstream points of the process as recycle gas or compressed for internal use as fuel gas.

Therefore, it is preferable that the pressure of the feed stream as measured in psia is not reduced across a single expansion step or cooling stage below about ⅓ of its inlet pressure (e.g. 1200 psia to 400 psia), and more preferably not below about ½ of its inlet pressure (e.g. 1200 psia to 600 psia) across a single expansion step or cooling stage. However, it is believed that such incremental pressure reduction of the feed stream is most beneficial when the feed stream is at high pressure. Consequently, the pressure drop of the feed stream across an expansion step or cooling stage may be to as low as atmospheric or near atmospheric pressures when the feed stream is at a low inlet pressure, preferably 150 psia or lower, more preferably 100 psia or lower, and most preferably 75 psia or lower for best results.

In a preferred embodiment, the number of cooling stages or expansion steps employed in the process is integrally related to the particular degree of pressure a reduction of the feed stream across each cooling stage or expansion step. For instance, a preferable process configuration with an initial feed stream having an inlet pressure of about 1200 psia will preferably utilize at least four cooling stages to process LNG provided that there is an incremental pressure drop, as measure in psia, of the inlet pressure of the feed stream by no more than ½ across each individual cooling stage.

Following one or more expansion steps, separator 16 separates the refrigerated vapor component and the liquid component. At least a portion of the refrigerated vapor component is sent to heat exchanger 12 via line 18 for indirect cooling of the feed stream. The balance of the refrigerated vapor component can be sent to one or more additional sequential cooling stages for further processing into LNG. Upon exiting heat exchanger 12, the refrigerated vapor component is preferably compressed in compressor 19 and introduced into the feed stream via line 20. Prior to being introduced into the feed stream, the refrigerated vapor component is preferably compressed to at least about the same pressure as the feed stream it is conveyed to. Alternatively, the refrigerated vapor component can be used as fuel gas for equipment, such as compressors required for the manufacture, storage and transport of LNG, sent to a purge flare, or sent to one or more additional downstream cooling stages for further processing into LNG. The refrigerated vapor component can be provided directly to fuel or may be compressed prior to being used as fuel gas. The liquid component from separator 16 can be sent to NGL recovery or to one or more additional sequential cooling stages for further processing via line 17.

Although not shown in the FIGURE, it is preferred to utilize at least two separation steps, each in conjunction with at least an equal number of expansion steps to enhance the production of LNG while reducing the overall power consumption of the process compared to other process that do not utilize such configuration. It is believed that utilizing this process configuration allows for and facilitates the production of refrigerated vapor components of varying temperatures and pressures. The lower pressure and temperature refrigerated vapor component is efficiently first directed to lower temperature cooling duty while the refrigerated vapor pressure of higher pressures and temperatures are efficiently first directed to intermediate and high temperature cooling duty. Additionally, the selection of refrigerated component (and the pressure of such component) can be configured to reduce the amount of power required to convey the refrigerated vapor component, thereby reducing the overall power consumption of the process.

In a preferred embodiment, at least two sequential cooling stages are utilized to produce LNG. Referring to the FIGURE, the feed stream to the second cooling stage enters heat exchanger 22 to produce a second cooled feed stream 23. The feed stream for each cooling stage subsequent to the first cooling stage preferentially comprises a liquid component produced during a previous cooling stage or refrigerated vapor component produced during a previous cooling stage, or both.

The second cooled feed stream 23 is sent to expander 24 where the second cooled feed stream is expanded to a lower pressure with a corresponding temperature reduction producing a liquid component and a refrigerated vapor component. Following one or more expansion steps, separator 26 separates the refrigerated vapor component and the liquid component. At least a portion of the refrigerated vapor component is sent to heat exchanger 22 via line 28 and heat exchanger 12 via line 29 to supply cooling for one or more feed streams of a previous cooling stage. Upon exiting heat exchanger 12 (or heat exchanger 22), the refrigerated vapor component is compressed by an intermediate compressor 30 (supplemented by or without compressor 19) producing a compressed vapor component 20. The compressed vapor component 20 may then be recycled into a feed stream of one or more previous cooling stages via line 11 or 17. The refrigerated vapor component is compressed to at least about the same pressure of the feed stream it is recycled into. Alternatively, the refrigerated vapor component or compressed vapor component can be used as fuel gas. The liquid component can be sent to storage or preferably to one or more additional cooling stages for further processing via line 27.

In yet another preferred embodiment, at least three sequential cooling stages are utilized to produce LNG. Referring to the FIGURE, the feed stream of the third cooling stage enters heat exchanger 32 to produce a third cooled feed stream. The third cooled feed stream is sent to an expander 34 via line 33 where the third cooled feed stream is expanded to a lower pressure with a corresponding temperature reduction producing a liquid component and a refrigerated vapor component.

Following one or more expansion steps, separator 36 separates the refrigerated vapor component and the liquid component. At least a portion of the refrigerated vapor component is sent to heat exchanger 32 via line 38, heat exchanger 22 via line 39, heat exchanger 12 via line 40 or all of the foregoing heat exchangers to supply cooling for one or more feed streams of a previous cooling stage. Upon exiting heat exchanger 12, heat exchanger 22, or heat exchanger 32, the refrigerated vapor component is preferentially compressed by one or more compressors producing a compressed vapor component 20. The compressed vapor component 20 may then be recycled into a feed stream of one or more previous cooling stages. The refrigerated vapor component is compressed to at least about the same pressure of the feed stream it is recycled into. Although not depicted in the FIGURE, it is often preferable to cool the compressed vapor component in one or more cooling steps prior to its use as a recycle stream. Alternatively, the refrigerated vapor component can be used as fuel gas. The liquid component can be sent to storage as LNG or preferably to one or more additional cooling stages for further processing via line 37. It is contemplated by the subject invention that any stream produced by one or more cooling stages of the process can be compressed by compressors 19, 30, and/or 42 and recycled back into the process for further processing or used as fuel gas.

In yet another preferred embodiment, at least four sequential cooling stages are utilized to produce LNG. Referring to the FIGURE, the feed stream of the fourth cooling stage enters heat exchanger 43 to produce a fourth cooled feed stream. The fourth cooled feed stream is sent to an expander 45 via line 44 where the fourth cooled feed stream is expanded to a lower pressure with a corresponding temperature reduction producing a liquid component and a refrigerated vapor component.

Following one or more expansion steps, separator 47 separates the refrigerated vapor component and the liquid component. At least a portion of the refrigerated vapor component is sent to heat exchanger 43 via line 49, heat exchanger 32 via line 51, heat exchanger 22 via line 52, heat exchanger 12 via line 53, or all of the foregoing heat exchangers to supply cooling for one or more feed streams of a previous cooling stage. Upon exiting heat exchanger 12, heat exchanger 22, heat exchanger 32, or heat exchanger 43, the refrigerated vapor component is preferentially compressed by one or more compressors producing a compressed vapor component 20. The compressed vapor component 20 may then be recycled into a feed stream of one or more previous cooling stages. The refrigerated vapor component is compressed to at least about the same pressure of the feed stream it is recycled into. Although not depicted in the FIGURE, it is often preferable to cool the compressed vapor component in one or more cooling steps prior to its use as a recycle stream. Alternatively, the refrigerated vapor component can be used as fuel gas. The liquid component can be sent to storage as LNG or preferably to one or more additional cooling stages for further processing via line 48. It is contemplated by the subject invention that any stream produced by one or more cooling stages of the process can be compressed by compressors 19, 30, 42 and/or 54 and recycled back into the process for further processing or used as fuel gas.

Overall, the present invention provides substantial benefits over closed-loop refrigerated LNG processes and open-circuit refrigerated LNG processes that do not utilize multiple cooling stages or multiple separation stages in conjunction with at least an equal number of expansion steps. The LNG process in accordance with the present invention achieves comparable or superior power efficiency than that associated with open-circuit refrigerated processes while maintaining higher LNG throughput not associated with typical open-circuit refrigeration LNG processes. The present invention alternatively allows for the production of fuel gas for immediate use in equipment, such as compressors that are required for the manufacture production, transport and storage of LNG, while maintaining a production rate of LNG comparable to typical open-circuit refrigeration LNG processes.

The present invention also provides for substantial capital cost-savings, such as the elimination of expensive closed-loop refrigeration circuits, high-pressure containers and transport equipment for handling the LNG product, and handling facilities and equipment required for processes producing high pressure LNG.

The present invention also provides for substantial safety benefits to person and property by not utilizing explosive external refrigerants for the manufacture, storage or transportation of LNG.

The present invention also provides for a simple and compact design option for the production of LNG facilitating implementation of the process at locations where plot space is at a premium or unavailable.

The present invention also provides for a high quality LNG product by producing LNG that has a low concentration of inert components, such as nitrogen.

Although the present invention has been described with particularity and detail, the following example provides further illustration of the invention and is understood not to limit the scope of the invention.

EXAMPLE

Process Simulation A for producing LNG, substantially in accordance with the present invention and the FIGURE, utilizing four cooling stages and four separation steps, was compared with process Simulation B for producing LNG utilizing a single cooling stage and a single separation step in an open-circuit system. The comparisons were made using detailed computer simulations and the results of the comparison are set forth in Table 1.

TABLE 1

| A | B |
|---|---|
| Feed Rate (kg/hr): $1.42 \times 10^5$ | Feed Rate (kg/hr): $1.22 \times 10^5$ |
| Feed Composition (Mole %): | Feed Composition (Mole %): |
| Methane: 83.7 | Methane: 83.7 |
| Ethane: 7.9 | Ethane: 7.9 |
| Propane: 2.1 | Propane: 2.1 |
| Butane: 1 | Butane: 1 |
| Nitrogen: 5.3 | Nitrogen: 5.3 |
| Feed Pressure (psia): 1,450 | Feed Pressure (psia): 2,940 |
| Feed Temperature (° F.): 95 | Feed Temperature (° F.): 95 |
| Cooling Stages: 4 | Cooling Stages: 1 |
| Stream Pressure After Expansion (psia): | Stream Pressure After Expansion (psia): |
| 1st Expansion: 500 | 1st Expansion: 294 |
| 2nd Expansion: 170 | 2nd Expansion: 14.7 |
| 3rd Expansion: 60 | |
| 4th Expansion: 14.7 | |
| Stream Temperature After Expansion (° F.): | Stream Temperature After Expansion (° F.): |
| 1st Expansion: −130 | 1st Expansion: −170 |
| 2nd Expansion: −180 | 2nd Expansion: −266 |
| 3rd Expansion: −215 | |
| 4th Expansion: −258 | |
| Number of Separation Steps: 4 | Number of Separation Steps: 1 |
| Product Rate (kg/hr): $1.22 \times 10^5$ | Product Rate (kg/hr): $1.22 \times 10^5$ |
| LNG Composition (Mole %): | LNG Composition (Mole %): |
| Methane: 86.8 | Methane: 83.7 |
| Ethane: 8.9 | Ethane: 7.9 |
| Propane: 2.4 | Propane: 2.1 |
| Butane: 1.1 | Butane: 1.0 |
| Nitrogen: 0.7 | Nitrogen: 5.3 |
| Power Consumption: 58.4 MW | Power Consumption: 64.1 MW |
| Fuel Produced (kg/hr): $2.05 \times 10^4$ @ 504.7 psia | Fuel Produced (kg/hr): 0 |
| Fuel Composition (Mole %): | |
| Methane: 62.9 | |
| Ethane: 1.1 | |
| Propane: 0.1 | |
| Butane: 0.0 | |
| Nitrogen: 35.8 | |

Referring to Table 1, Simulation A, the process of the present invention, surprisingly consumes only 58.4 MW of power to produce LNG at a rate of $1.22\times10^5$ kg/hr while Simulation B, a single stage open circuit system, consumes 64.1 MW of power to produce LNG at a rate of $1.22\times10^5$ kg/hr demonstrating the substantial operating cost benefit of Simulation A over Simulation B. Additionally, Simulation A internally produces fuel at a rate of $2.05\times10^4$ available at a pressure of 504.7 psia, while Simulation B does not produce fuel and must import and hydraulically convey an external source of fuel to operate equipment, such as compressors, to produce its LNG. Alternatively, Simulation A can produce LNG at a higher rate than $1.22\times10^5$ kg/hr in lieu of fuel production.

In addition to the foregoing substantial cost and power benefits, Simulation A produces a superior LNG product over the LNG product produced by Simulation B. As illustrated in Table 1, LNG produced by Simulation A contains only 0.7% nitrogen, while LNG produced by Simulation B contains 5.3% nitrogen. Such a high composition of nitrogen and other inert components in LNG is disfavored by the consuming public because nitrogen cannot be utilized as a fuel source. Furthermore, nitrogen greatly increases the vapor pressure of LNG requiring additional costs for its storage and transport to distant markets.

The superior performance of Simulation A compared to Simulation B is attributed to the novel design characteristics of the subject invention, including but not limited to staging the degree of pressure reduction of the process feed stream across multiple cooling stages, and deriving the necessary refrigeration for the process from cooled vapor components produced at multiple points throughout the process by utilizing multiple separation steps in conjunction with multiple expansion steps. The efficient design of the present invention also allows for the production of fuel gas for immediate use in equipment, such as compressors that are required for the manufacture production, transport and storage of LNG, while maintaining a high production rate of LNG that is marketable to the consuming public.

That which is claimed is:

1. A process for producing LNG, comprising:

(a) directing a feed stream comprising natural gas to a cooling stage, the cooling stage comprising the steps of: (i) cooling the feed stream in at least one cooling step producing a cooled feed stream; (ii) expanding the cooled feed stream in at least one expansion step by reducing the pressure of the cooled feed stream producing a refrigerated vapor component and a liquid component; and (iii) separating at least a portion of the refrigerated vapor component from the liquid component; and (b) repeating step (a) one or more times until at least a substantial portion of the feed stream in the first cooling stage is processed into LNG wherein the feed stream comprises at least a portion of the liquid component from step (iii) of a previous cooling stage;

wherein at least a portion of the cooling for step (i) in at least one cooling stage is derived from at least a portion of the refrigerated vapor component produced in at least one cooling stage.

2. The process of claim 1, wherein the feed stream in step (a) for each successive cooling stage further comprises at least a portion of the refrigerated vapor component from step (iii) of a previous cooling stage.

3. The process of claim 1, wherein step (a) is repeated at least two additional times.

4. The process of claim 1, wherein step (a) is repeated at least three additional times.

5. The process of claim 1, wherein at least one cooling stage further comprises the step of compressing the refrigerated vapor component to produce a compressed vapor component.

6. The process of claim 5, wherein at least one cooling stage further comprises the step of recycling the compressed vapor component into the feed stream from at least one cooling stage.

7. A process for producing LNG, comprising:

(a) directing a feed stream to a cooling stage, the cooling stage comprising the steps of: (i) cooling the feed stream in at least one cooling step producing a cooled feed stream; (ii) expanding the cooled feed stream in at least one expansion step by reducing the pressure of the cooled feed stream producing a refrigerated vapor component and a liquid component; and (iii) separating at least a portion of the refrigerated component from the liquid component; and (b) repeating step (a) one or more times wherein the feed stream comprises the liquid component from step (iii) of at least one cooling stage;

wherein at least a portion of the cooling for step (i) in at least one cooling stage is derived from at least a portion of the refrigerated vapor component produced in at least one cooling stage;

wherein the inlet pressure of the feed stream in step (b), as measured in psia, is at least ⅓ the inlet pressure of the feed stream, as measured in psia, of the immediately preceding cooling stage provided that the inlet pressure of said feed stream of the immediately preceding cooling stage is at least 75 psia.

8. The process of claim 7, wherein the inlet pressure of the feed stream in step (b) is at least ⅓ the inlet pressure of the feed stream of the immediately preceding cooling stage provided that the inlet pressure of said feed stream of the immediately preceding cooling stage is at least 150 psia.

9. The process of claim 7, wherein the inlet pressure of the feed stream in step (b) is at least ½ the inlet pressure of the feed stream of the immediately preceding cooling stage provided that the inlet pressure of said feed stream of the immediately preceding cooling stage is at least 150 psia.

10. The process of claim 7, wherein the inlet pressure of the feed stream in step (b) is at least ½ the inlet pressure of the feed stream of the immediately preceding cooling stage provided that the inlet pressure of said feed stream of the immediately preceding cooling stage is at least 75 psia.

11. The process of claim 7, wherein the pressure of the feed stream in the first cooling stage is at least 1000 psia and step (a) is repeated at least two additional times.

12. The process of claim 8, wherein the pressure of the feed stream in the first cooling stage is at least about 1000 psia and step (a) is repeated at least three additional times.

13. The process of claim 9, wherein the pressure of the feed stream in the first cooling stage is at least about 1000 psia and step (a) is repeated at least three additional times.

14. The process of claim 7, wherein at least one cooling stage further comprises the step of recycling the compressed vapor component into the feed stream from at least one previous cooling stage.

15. A process for producing LNG, comprising:

(a) sending a feed stream comprising natural gas to a cooling stage, the cooling stage comprising the steps of: (i) cooling the feed stream in at least one cooling step producing a cooled feed stream; (ii) expanding the cooled feed stream in at least one expansion step by reducing the pressure of the cooled feed stream producing a refrigerated vapor component and a liquid component; and (iii) separating in at least one separation step at least a portion of the refrigerated component from the liquid component;

(b) repeating step (a) one or more times wherein the feed stream comprises at least a portion of the liquid component from step (iii) of a previous cooling stage;

wherein at least a portion of the cooling for step (i) in at least one cooling stage is derived from at least a portion of the refrigeration vapor component produced in at least one cooling stage, and wherein at least one cooling stage employs multiple separation steps that are integrally operated with at least an equal number of expansion steps.

16. The process of claim 15, wherein step (a) is repeated at least two times.

17. The process of claim 15, wherein step (a) is repeated at least three times.

18. The process of claim 15, wherein at least one cooling stage further comprises the step of compressing the refrigerated vapor component to produce a compressed vapor component.

19. The process of claim 18, wherein at least one cooling stage further comprises the step of recycling the compressed vapor component into the feed stream from at least one cooling stage.

20. The process of claim 19, wherein the compressed vapor component is recycled into the feed stream of the first cooling stage.

21. A process for producing LNG, comprising:

(a) directing a feed stream having a pressure of at least 1,000 psia to a first cooling stage, the first cooling stage comprising the steps of: (i) cooling the feed stream producing a cooled feed stream; (ii) expanding the cooled feed stream by reducing the pressure of the cooled feed stream producing a refrigerated vapor component and a liquid component; and (iii) separating at least a portion of the refrigerated vapor component from the liquid component; and (b) directing a second feed stream comprising at least a portion of the liquid component produced in the first cooling stage and having a pressure, at least ⅓ the pressure of the first feed stream to a second cooling stage, the second cooling stage comprising the steps of: (i) cooling the second feed stream producing a second cooled feed stream; (ii) expanding the second cooled feed stream by reducing the pressure of the second cooled feed stream producing a second refrigerated vapor component and a second liquid component; and (iii) separating at least a portion of the second refrigerated vapor component from the second liquid component;

wherein at least a portion of the cooling for step (i) in the first cooling stage or for step (i) in the second cooling stage is derived from at least a portion of the refrigerated vapor component or from at least a portion of the second refrigerated component.

22. The process of claim 21, further comprising directing a third feed stream comprising at least a portion of the second liquid component produced in the second cooling stage and having a pressure at least ⅓ the pressure of the second feed stream to a third cooling stage, the third cooling stage comprising the steps of (i) cooling the third feed stream producing a third cooled feed stream; (ii) expanding the third cooled feed stream by reducing the pressure of the third cooled feed stream producing a third refrigerated vapor component and a third liquid component; and (iii) separating at least a portion of the third refrigerated vapor component from the third liquid component;

wherein at least a portion of the cooling for step (i) in the first, second or third cooling stages is derived from at least a portion of the refrigerated vapor component, at least a portion of the second refrigerated component or at least a portion of the third refrigerated component.

* * * * *